United States Patent [19]

Ahlf et al.

[11] 4,416,034

[45] Nov. 22, 1983

[54] FRONT-SUCTION ARRANGEMENT ON A VACUUM CLEANER

[75] Inventors: Heinz-Jürgen Ahlf, Berg.-Gladbach; Wieland Gühne, Remscheid, both of Fed. Rep. of Germany

[73] Assignee: Vorwerk & Co. Interholding GmbH, Wuppertal, Fed. Rep. of Germany

[21] Appl. No.: 313,757

[22] Filed: Oct. 22, 1981

[30] Foreign Application Priority Data

Nov. 6, 1980 [DE] Fed. Rep. of Germany ..... 3041881

[51] Int. Cl.[3] ..... A47L 9/02

[52] U.S. Cl. ..... 15/354; 15/418; 15/419

[58] Field of Search ..... 15/319, 354, 355, 356, 15/418, 419

[56] References Cited

U.S. PATENT DOCUMENTS 2,513,587 7/1950 Reeves ..... 15/319

*Primary Examiner*—Chris K. Moore

*Attorney, Agent, or Firm*—Michael J. Striker

[57] ABSTRACT

An arrangement for front suction on a vacuum cleaner, which includes a lever or a spring on a front side of the vacuum cleaner. The lever or the spring lifts the vacuum cleaner from the floor in response to a counter pressure exerted on the lever or the spring by a limiting wall, when the vacuum cleaner abuts against that limiting wall.

7 Claims, 4 Drawing Figures

FRONT-SUCTION ARRANGEMENT ON A VACUUM CLEANER

BACKGROUND OF THE INVENTION

The present invention relates in general to vacuum cleaners. More particularly, the invention relates to an arrangement for front suction on a vacuum cleaner.

The arrangements for front suction provided on vacuum cleaners are known in the art. These arrangements include a number of additional openings made in the housing or a plurality of so-called floor plates. The additional openings or plates serve for suction of dust at the front side of the vacuum cleaner when the latter is moved by a user in a forward direction.

These known arrangements however, have certain disadvantages. For example, the additional openings significantly increase a sliding force to be exerted by a user to move the vacuum cleaner inasmuch as these openings reduce a resting surface of the vacuum cleaner. Furthermore, the overall dust absorption is significantly reduced because these openings function as lateral air openings. Theoretically, such an arrangement increases a suction stream.

SUMMARY OF THE INVENTION

It is an object of the invention to avoid the disadvantages of the prior art.

Another object of the invention is to provide an improved arrangement for front suction.

Still another object of the invention is to provide an arrangement for front suction in which dust absorption will not be reduced and which will be utilized when desired.

These and other objects of the invention are attained by a device for front suction on a vacuum cleaner including a housing having a front side as viewed in a direction of traveling of the vacuum cleaner, comprising means on said front side for lifting said front side from a floor, said lifting means being operative in response to a counter pressure exerted on said means by a limiting surface when said means is brought into contact with said limiting surface.

The lifting means may include a pivotable lever mounted on said housing.

The pivotal lever may be spring-loaded in the direction of traveling and adapted to pivot in a direction of the floor under said counter pressure and thus lift the front side when the lever rests against the floor.

The lever may pivot back to its initial position upon ceasing the counter pressure.

The lifting means may include at least one curved leaf spring and a slide, one end of said spring being connected to the slide.

The front side of the housing may be formed with an elongated groove, the slide being slidably positioned in said groove.

Another end of the spring may be rigidly connected to said housing, the spring in response to said counter pressure urging said slide to rest against the floor and thus lift said front side.

A number of leaf springs and corresponding slides may be provided in the front suction arrangement in accordance with the invention.

Only one spring and a number of slides rigidly connected to each other may be suggested in one of the modified embodiments of the invention.

It should be noted that the advantage of the front suction arrangement proposed herein resides in that this arrangement does not negatively effect the outcome of dust absorption and is used only when required.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
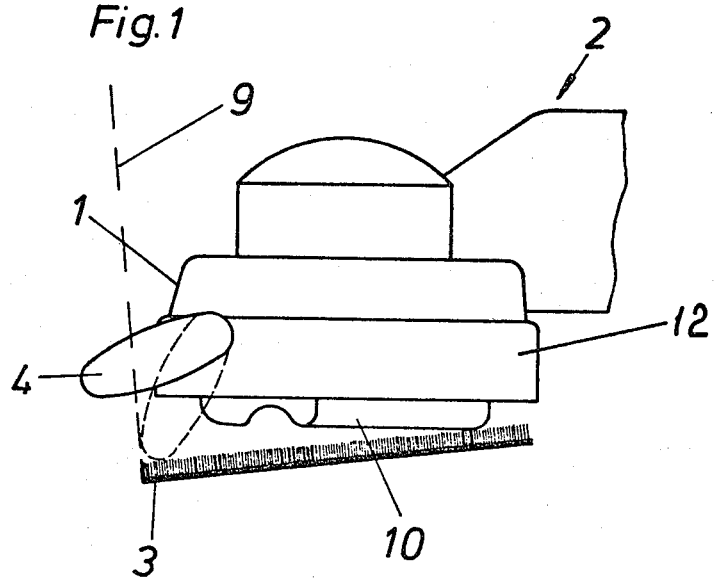
FIG. 1 is a side view of a vacuum cleaner with a lifting arrangement according to the invention.

FIG. 1 illustrates a floor nozzle 2 of a vacuum cleaner set to clean a surface 3 of the floor. The vacuum cleaner has a front side 1 which is provided with a pivotal lever 4. This pivotal lever is in a usual manner spring-loaded by a spring (not shown) mounted on a housing 12 of the vacuum cleaner. The lever 4 pivots between two positions depicted in the drawing by solid and dotted lines, respectively. If the ejector of the vacuum cleaner travels towards a limiting surface 9, which may be a wall or any other obstacle (shown in the drawing by a dotted line substantially normal to the floor 3), so that lever 4 is brought into contact with wall 9, the lever 4 then pivots from the position shown by the solid line to the position shown by the dotted line. When lever 4 rests against the floor 3 it lifts the vacuum cleaner with its bottom plate 10 from floor 3. In this raised position air will be sucked from the front side of the vacuum cleaner and so-called front suction will take place.

Now, if the vacuum cleaner floor nozzle is moved rearwardly by a user lever 4 will pivot to its initial position and the bottom plate 10 will lower and thus rest against the floor 3.

Figure 2:
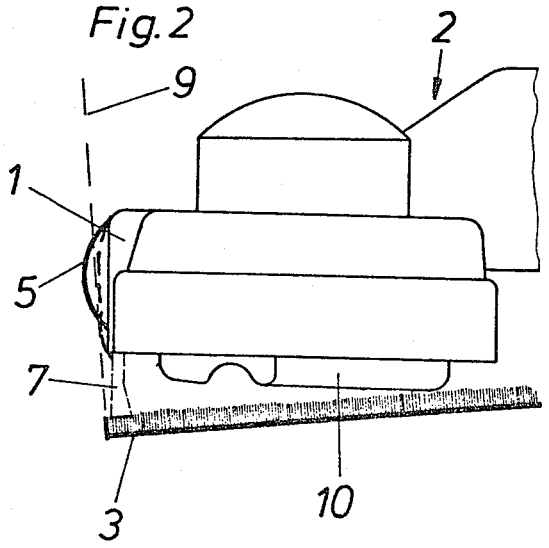
FIG. 2 is a side view of a vacuum cleaner with a modified lifting arrangement.
Figure 3:
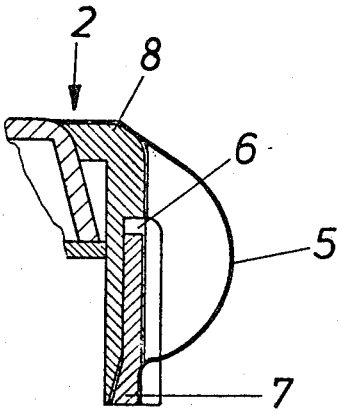
FIG. 3 is an axial section, in portion, of the arrangement shown in FIG. 2.

FIGS. 2 and 3, illustrate a second embodiment of the arrangement for front suction in accordance with the invention. The vacuum cleaner floor nozzle 2 is at its front side provided with a curved leaf spring 5 the upper end of which is rigidly connected to the housing 12 of the vacuum cleaner whereas its lower end is connected to a slide 7. FIG. 3 depicts the second embodiment in detail. The slide 7 is slidably mounted within a groove 6 formed in the housing 12.

In operation, when a user moves the vacuum cleaner and brings the latter against the wall 9 (FIG. 2) the leaf spring 5 is pressed by wall 9 so that spring 5 is compressed and takes a position shown by a dotted line. This causes the slide 7 to move downwardly within the groove 6. When slide 7 abuts against the floor 3 it lifts the lower plate 10 and thus the vacuum cleaner to thereby permit the front suction.

Figure 4:
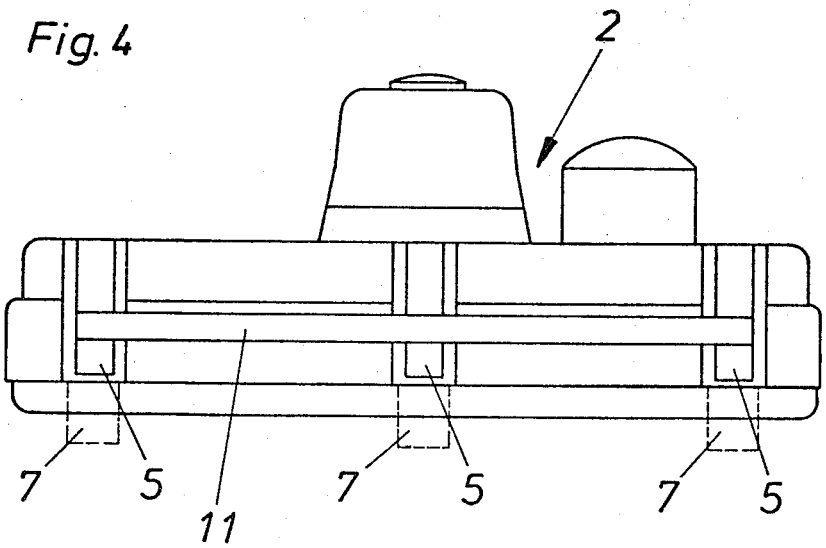
FIG. 4 is a front view of a vacuum cleaner with a lifting arrangement including a plurality of slides.

In the embodiment shown in FIG. 4 a number of curved leaf springs 5 similar to those depicted in FIG. 2 and respectively connected to a number of slides 7 are provided. The leaf springs 5 are interconnected by a connecting rod 11 so that when only one spring is compressed by a counter pressure exerted by the wall 9 the remaining springs 5 and thus slides 7 will be actuated to lift the vacuum cleaner from the floor.

It will be understood that each of the elements described above, or two or more together, may also find a useful application in other types of arrangements for front suction differing from the types described above.

While the invention has been illustrated and described as embodied in a device for a front suction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for front suction on a vacuum cleaner including a housing having a front side as viewed in a direction of traveling of the vacuum cleaner and a bottom plane, comprising lifting means mounted to said front side and operative for lifting said front side from a floor in response to a counter pressure exerted on said lifting means by a limiting surface when said lifting means is brought into contact with said limiting surface, said lifting means including a pivotable lever pivotable about a pivot point located on said front side of the housing at a predetermined distance from said bottom plane, said lever being longer than said predetermined distance and being spring-loaded in said direction of traveling and adapted to pivot in the direction of the floor under said counter pressure and thus lift said front side when the lever rests against the floor.

2. The device as defined in claim 1, wherein said pivotable lever points back to its initial position upon ceasing said counter pressure.

3. A device for front suction on a vacuum cleaner including a housing having a front side as viewed in a direction of traveling of the vacuum cleaner and a bottom plane, comprising lifting means mounted to said front side and operative for lifting said front side from a floor in response to a counter pressure exerted on said lifting means by a limiting surface when said lifting means is brought into contact with said limiting surface, said lifting means including at least one curved leaf spring having one end rigidly connected to the front side of the housing and another end, and a slide slidably mounted on the housing, said another end of said spring being rigidly connection to said slide, said spring in response to said counter pressure urging said slide to rest against the floor and thus lift said front side.

4. The device as defined in claim 3, wherein said front side is formed with an elongated groove, said slide being slidably positioned in said groove.

5. The device as defined in claim 4, wherein a number of leaf springs and corresponding slides are provided.

6. The device as defined in claim 5, wherein said leaf springs are connected to each other by a connecting rod.

7. The device as defined in claim 3, wherein only one spring and a number of slides are provided, said slides being rigidly connected to each other.

* * * * *